US005948509A

United States Patent [19]

Felson

[11] Patent Number: 5,948,509

[45] Date of Patent: Sep. 7, 1999

[54] NON COLLAPSING PRE-ASSEMBLED FLEXIBLE DUCT CONNECTOR

[76] Inventor: Raymond Murray Felson, 56 Rugby Pl., Montreal West, Quebec, Canada, H4X1C4

[21] Appl. No.: 08/697,579

[22] Filed: Aug. 27, 1996

[51] Int. Cl.[6] ..... B32B 23/02

[52] U.S. Cl. ..... 428/192; 285/49; 285/235; 285/419; 138/172

[58] Field of Search ..... 285/235, 236, 285/49, 257, 260, 294 L; 138/172, DIG. 4, 177, 178; 428/192, 88, 298.1

[56] References Cited

U.S. PATENT DOCUMENTS

| | | | |
|---|---|---|---|
| Re. 14,563 | 12/1918 | Braly | 285/260 |
| 499,042 | 6/1893 | Robbins | 285/235 X |
| 1,467,933 | 9/1923 | Hanley | 138/172 |
| 2,293,360 | 8/1942 | Reilly et al. | 285/235 X |
| 3,030,130 | 4/1962 | Appleton | 285/257 |
| 3,100,658 | 8/1963 | Miller et al. | 285/294.2 X |
| 3,516,694 | 6/1970 | Schwartz | 285/236 |
| 3,715,454 | 2/1973 | Kleykamp | 138/172 X |
| 4,089,131 | 5/1978 | Phillips | 285/260 X |
| 4,824,146 | 4/1989 | Redfield | 285/236 X |
| 4,861,631 | 8/1989 | Hinden et al. | 285/294.2 X |

FOREIGN PATENT DOCUMENTS

| | | | |
|---|---|---|---|
| 874806 | 7/1971 | Canada | 138/172 |
| 492798 | 7/1919 | France | 285/260 |
| 6147375 | 5/1994 | Japan | 285/235 |
| 1214468 | 12/1970 | United Kingdom | 285/260 |

*Primary Examiner*—Dave W. Arola
*Attorney, Agent, or Firm*—Wall Marjama Bilinski & Burr

[57] ABSTRACT

A continuous length of pre-assembled, metal-to-fabric-to-metal stock material for fabricating custom-made, flexible duct connectors of any diameter which incorporate a structural means for minimizing the risk of inward collapse of a fabric strip when the fabric strip is subjected to considerable negative air pressure due to installation between a duct and an inlet of an axial flow fan or blower.

17 Claims, 2 Drawing Sheets

NON COLLAPSING PRE-ASSEMBLED FLEXIBLE DUCT CONNECTOR

FIELD OF THE INVENTION

This invention relates to a means for minimizing the collapse inward of the fabric which forms an integral part of pre-assembled flexible duct connector when a precut length of this connector is fabricated into circular collars which are then installed on the vacuum (negative pressure) side of axial flow fans and blowers between the circular inlets to the equipment and the related ductwork.

BACKGROUND OF THE INVENTION

Flexible Duct Connector is used to isolate and thereby prevent the transmission of vibrations generated by axial flow fans and blowers in airduct systems.

Ever since vibratory sound transmitted to ductwork was recognized as a problem, designers and installers have incorporated fabric sound isolators between fans/blowers and ductwork, both at the intake and discharge stations of the equipment. The shop method generally used was to form a fabric sleeve of which one end was fitted over the duct, the other end over the inlet flange of the equipment. There were several means of securing the fabric in place including draw bands, metal strips screwed over the fabric into the duct, etc. More recently shops began to clench metal strips to fabric on shop equipment, a time consuming and oftentimes leak-prone process.

Commercially available pre-assembled flexible duct connector, made on specialized roll forming machines, first appeared on the North American market more than 40 years ago. It offers an efficient, cost effective alternative to shop made connector. This product is usually produced in 100 foot coiled lengths consisting of a three inch wide strip of thin, industrial grade fabric to which three inch wide metal strips are clenched continuously to the fabric along each of it's two edges with single fold or double fold seams, yielding a side-by-side, metal-to-fabric-to-metal assembly about nine inches in width. (Occasionally the fabric width may be increased to as much as six inches to accommodate large fans and blowers). Pieces are then cut to length from a coil, formed into round, square or rectangular collars and then installed between the equipment and the corresponding ductwork.

When flexible connector is not used, especially in high velocity/high pressure systems, the noise which can be generated as the result of direct contact between duct and equipment may range from moderately objectionable to unacceptable, particularly in office buildings, hospitals and libraries, etc.

To meet this noise suppression requirement the width of the fabric portion need only be sufficient to physically separate the duct from the equipment. In theory this fabric strip could be as narrow as one inch.

There is a second requirement, however, that dictates a greater width. Blowers and fans are usually installed on vibration absorbing pads which also prevent their vibrations from being transmitted directly to the floor, walls or ceiling onto which the equipment may be installed. Depending upon the physical size and rotational speed of the equipment, a fan or blower will move away from its static position when activated, sometimes by as much as 2–3 inches, creating a misalignment between the equipment and the duct. There is therefore a need for the fabric portion of the connector, when installed, to be sufficiently wide to allow for slack in order to accommodate this displacement. It is this 'slack' that creates a problem which can be explained as follows.

When flexible duct connector collars are installed allowing for slack at both inlet and discharge of fans and blowers, the slack on the discharge or positive pressure side of the equipment simply allows the fabric to 'balloon' outwards. While this enlargement of the free x-sectional area at the fabric portion is not really desirable, it does not create much of an airflow efficiency problem.

The opposite is true of flexible connector collars installed between the round duct and the inlet (suction/vacuum) side of the equipment. The inlet flanges are almost always round in shape. The fabric portion of the collar invaginates (collapses inward) as the air passing through it, on its way to the equipment inlet, sucks the fabric inwards. This invagination can seriously reduce the net free X-sectional area at the fabric, creating a restriction that will reduce the fan/blower efficiency to a degree where theoretical airflow delivery calculations can no longer be met. This is especially serious in the case of axial flow fans where the propellor tips produce most of the air movement. In order to control this invagination some engineers will actually call for a shop made internal skeletal 'cage' to be installed at the fabric area . . . costly and occasionally cumbersome and ineffective.

SUMMARY OF THE INVENTION

The object of the invention is to remedy the invagination problem on round connector collars that are installed at fan and blower air inlets on duct systems.

Utilizing the principle that a circular ring of correct flexure and strength cannot collapse inwardly towards its center when centripetal pressures are applied, the invention proposes such a ring(s) be fastened longitudinally along the fabric in such a way that the ring is completely isolated from either adjacent metal strip but 'floats' between these strips when the connector sleeve is installed. The ring will minimize invagination of the fabric on either side of it. It can be made of metal, fibre, plastic or any such material having sufficient strength and flexure and may be permanently attached to the fabric.

Depending upon the width of the fabric, which can be as much as six inches, more than one ring may be incorporated. Flat metal and wire rings are both acceptable just so long as they are sufficiently stiff to withstand the tendency to collapse when subjected to the sucking action of the air. Several parallel rings on wide fabric will offer better control of invagination than a single ring. Practical considerations will determine the correct number of rings to be incorporated into the connector fabric or attached to it.

BRIEF DESCRIPTION OF THE DRAWINGS

Several embodiments of the invention will now be described by way of example, with reference to the accompanying drawings of which.

DETAILED DESCRIPTION OF THE INVENTION

Figure 1:
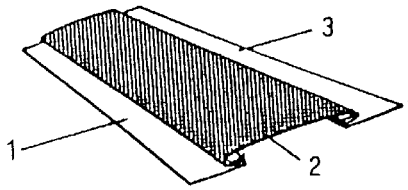
FIG. 1 PRIOR ART
FIG. 1 illustrates a typical severed length of conventional pre-assembled flexible duct connector with two metal strips, each clenching the central fabric strip along opposite edges.
Figure 2:
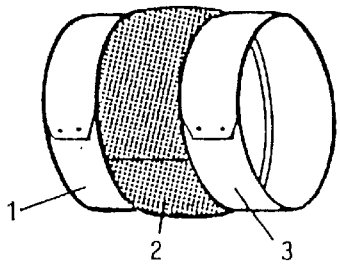
FIG. 2 PRIOR ART
FIG. 2 illustrates a simplified version of a formed round collar fabricated from a length of conventional pre-assembled flexible duct connector which has been fully extended before forming and which is fastened with overlapping seams.

In FIGS. 1 and 2, two metal strips 1 and 3 clasp the fabric portion 2 of a conventional pre-fabricated flexible duct connector assembly with continuous single or double fold seams. FIG. 1 shows the connector assembly in its flat condition as it emerges from the roll-forming equipment. FIG. 2 shows the same connector formed into a circular collar, fastened with overlap seams and ready for installation. The clenched fabric portion 2 is free to be manipulated axially like a bellows or laterally so as to compensate for duct-to-equipment misalignment. Only the width of the fabric portion restricts its freedom to move in all directions.

Figure 3:
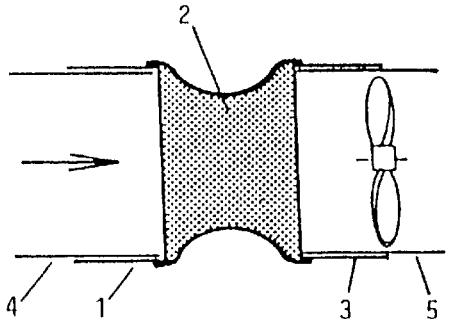
FIG. 3 PRIOR ART
FIG. 3 illustrates a cutaway view of the collar shown in FIG. 2 which has been installed between a round duct and the round inlet flange of an activated axial flow fan with allowance for slack, the fabric having invaginated due to suction created by the fan.

FIG. 3 shows the collar of FIG. 2 in cutaway section, one metal end 1 placed tightly over a round duct end 4, the other end 3 over a circular inlet flange and axial flow fan assembly 5. The metal ends 1 and 3 are positioned in a non-extended mode to permit slack in the fabric sleeve 2. Air movement through the duct, shown by an arrow, creates a suction at the fabric portion, causing it to invaginate, reducing its free x-sectional area, thereby restricting the passage of air through it. The degree of constriction, which can be considerable, is dependant upon the physical size of the duct and equipment, the amount of slack in the fabric sleeve and the air volume and static pressure of the system.

Figure 4:
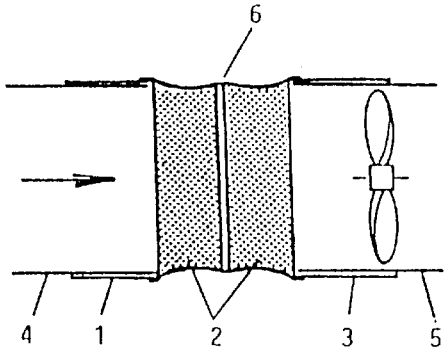
FIG. 4 illustrates a cutaway view of a similar collar to that shown in FIG. 3, which has been installed between a round duct and the round inlet flange of an axial flow fan, with allowance for slack, but which incorporates a floating, formed stiffening ring running parallel to but completely independent of the two metal strips clenching the fabric.

In FIG. 4 the same air movement conditions exist as in FIG. 3 except that a flat metal ring 6 has been introduced, substantially centrally and running parallel to the metal strips 1 and 3 and within the fabric sleeve 2 to which it is permanently affixed. The ring 'floats' within the fabric sleeve and cannot make physical contact with metal strips 1 and 3 when the fan is actuated.

Figure 5:
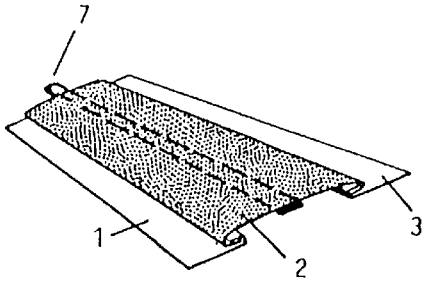
FIG. 5 illustrates a length of pre-assembled flexible duct connector to which a floating, flexible flat metal strip is permanently and centrally attached to the underside of the fabric along its entire length.

In FIG. 5 the flat metal strip 7, shown as a formed ring 6 in FIG. 4, is permanently attached centrally to the fabric 2, either to the top or the bottom surface of the fabric and running longitudinally with the fabric portion, by any one of the several means which will be described more fully, taking into account the compatibility of the metal strip material and the fabric composition.

Figure 6:
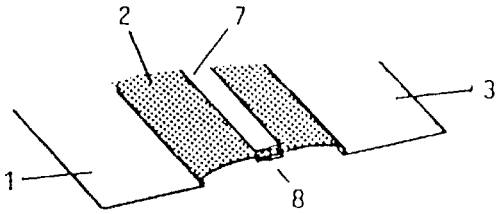
FIG. 6 shows a length of connector as in FIG. 5 incorporating a second superposed flat metal strip, mounted on the opposite fabric face to that shown in FIG. 5.

Another example of utilizing the flat strip stiffener 7 shown in FIG. 5 requires the addition of an identical second, superposed flat strip 8 as shown in FIG. 6 placed against the opposite fabric surface in perfect alignment with the first strip, the two strips being mechanically attached, one to the other through the fabric.

Figure 7:
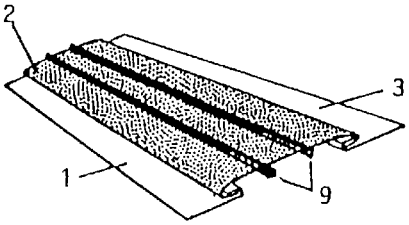
FIG. 7 illustrates a length of pre-assembled flexible duct connector which incorporates two flexible wire pieces which are permanently fastened to the fabric strip and which run parallel to each other and to the two metal strips clenching the fabric.

In FIG. 7 the flat metal strip 7 shown in FIG. 5 is replaced by one or more tempered round wire pieces 9, either to the upper or to the lower surface of the fabric and acts in the same way to stiffen the fabric portion, preventing invagination of the fabric in the immediate area of the wire pieces.

Figure 8:
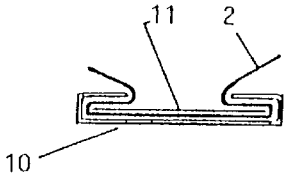
FIG. 8 is a sectional view of a stiffening method wherein a "U" shaped metal strip is made to clench a narrower, thin metal strip so as to contain both the narrow strip and the fabric portion of the connector.

In FIG. 8 another example of a practical stiffening method is the placement of the legs of a "U" shaped metal channel 10 in contact with one surface of the fabric 2, top or bottom, the introduction of a second, narrower strip 11 against the opposite face of the fabric and which is mechanically inserted into the trough of the U-shaped channel so that both the narrow strip 11 and the fabric portion in direct contact with it are contained within the "U" shaped channel which is then bent further to firmly clench both the narrow strip 11 and the fabric so that the fabric is firmly held within the clasped metal assembly and cannot be easily withdrawn.

Figure 9:
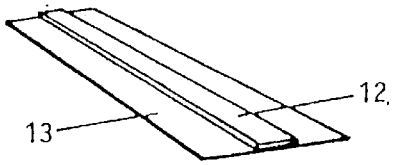
FIG. 9 illustrates a sub-assembly of a fabric or plastic tape to which a narrow, thin and flexible metal or plastic strip has been longitudinally and centrally affixed.

In FIG. 9 a thin, narrow metal strip 12 has been affixed to a continuous length of fabric or plastic tape 13, with or without adhesive backing, the sub assembly of metal strip and tape being in a prepared state for direct application to the fabric portion of pre-assembled flexible connector as shown in FIG. 5. Attachment can be effected by means of adhesive, heat sealing, stitching or similar means.

Figure 10:
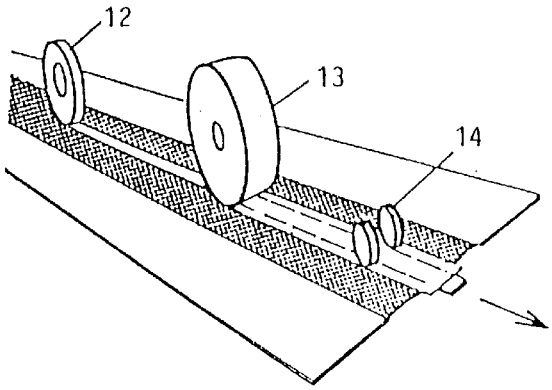
FIG. 10 demonstrates a metal flexural strip being applied to conventional, unstiffened pre-assembled flexible duct connector, the strip being held in place by a fabric tape.
Figure 11:
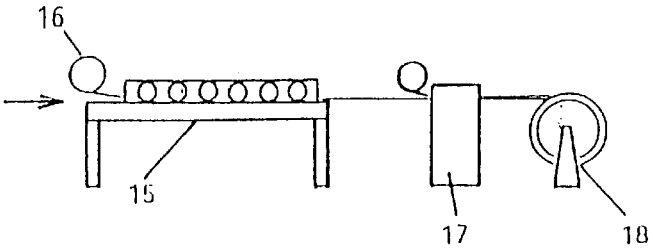
FIG. 11. shows a progressive manufacturing unit consisting of a specialized roll forming machine, a remote secondary machine station and finally, a takeup reel station.
Figure 12:
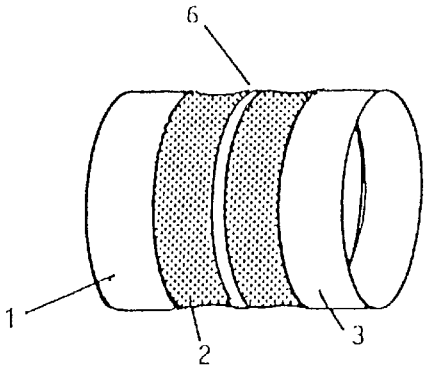
FIG. 12 illustrates a made up collar, shown as a cutaway view in FIG. 4, with a floating metal ring affixed to the outside fabric surface.

FIG. 10 shows a thin, narrow metal strip 12 and fabric tape 13 as in FIG. 9 being applied to the unstiffened fabric portion 2 of pre-assembled flexible duct connector, as it emerges from a roll forming station shown in FIG. 11, by means of, for example, a continuous heat-sealing operation, the rolls of which are designated by 14.

FIG. 11 illustrates a specialized roll-forming machine 15 with progressive forming stations, feeding means for conveying steel strips 1 and 3, as they are shown in FIGS. 1 through 8, to clench the fabric 2, which is itself being fed from a fabric roll 16, with single or double fold seams. An additional station 17, which can be attached to, be a part of or be remote from the roll-forming machine, applies one of the stiffening means illustrated in FIGS. 5, 6, 7, 8 or 9 to the otherwise conventional flexible duct connector which has been produced in the roll-forming machine. The 'stiffened' connector is then coiled onto a takeup reel 18, severed from the continuous assembly in pre-determined lengths and placed into cartons.

There are other embodiments of the invention which will be apparent to persons skilled in the art, the scope of the invention being defined in appended claims:

What I claim as new and wish to protect by Letters Patent of the United States is:

1. A continuous length of pre-assembled, metal-to-fabric-to-metal stock material for fabricating custom-made duct connectors of varying diameters, comprising:

an elongate, continuous fabric strip;

an elongate first metal edge strip clenched to one side of said fabric strip;

an elongate second metal edge strip clenched to an opposite side of said fabric strip; and at least one elongate reinforcing spine stiffener attached to a first surface of said fabric strip, said reinforcing spine stiffener running substantially parallel to said first and second metal edge strips, wherein said reinforcing spine stiffener comprises a flat metal ring which is substantially centrally attached to said fabric strip, and substantially in parallel-alignment with said metal edge strips to form a continuous circular collar-shaped duct connector, wherein said ring stiffens said continuous fabric strip.

2. A continuous length of stock material as recited in claim 1, wherein said reinforcing spine stiffener comprises an inner member and an outer member, with said fabric strip being interposed therebetween.

3. A continuous length of stock material as recited in claim 1, wherein said stock material comprises a plurality of reinforcing spine stiffeners.

4. A continuous length of stock material as recited in claim 3, wherein said reinforcing spine stiffeners are spaced apart from one another.

5. A continuous length of stock material as recited in claim 1, wherein said reinforcing spine stiffener is spaced substantially equidistant from each of said metal edge strips.

6. A continuous length of stock material as recited in claim 1, wherein said reinforcing spine stiffener is constructed from a material selected from the group consisting of metal, fiber or plastic.

7. A continuous length of stock material as recited in claim 1, wherein said spine stiffener possesses sufficient flexural strength to withstand collapse inward when said fabric strip of said circular collar-shaped duct connector is subjected to an internal suction pressure.

8. A continuous length of stock material as recited in claim 1, wherein said reinforcing spine stiffener is held in position on said fabric strip by a means selected from the group consisting of an adhesive, heat sealing, or stitching.

9. A continuous length of pre-assembled, metal-to-fabric-to-metal stock material for fabricating custom-made duct connectors of varying diameters, comprising:

an elongate, continuous fabric strip;

an elongate first metal edge strip clenched to one side of said fabric strip;

an elongate second metal edge strip clenched to an opposite side of said fabric strip; and at least one elongate reinforcing spine stiffener clamped to said fabric strip and comprising an outer member affixed to an elongate first surface section of said fabric strip and an inner member clamped within said outer member with said section of said fabric strip interposed between said outer and inner members, wherein the cross-sectional shape of said inner member is complementary to an inner cavity formed within the cross-section of said outer member so as to allow said outer member to be clamped around said inner member through said section of said fabric strip, thereby stiffening said continuous fabric strip.

10. A continuous length of stock material as recited in claim 9, wherein the cross-sectional shape of said outer member is that of a rectangle with one side open through which said fabric strip extends, and the cross-sectional shape of said inner member is that of a flat strip.

11. A continuous length of stock material as recited in claim 9, wherein said reinforcing spine stiffener is spaced substantially equidistant from each of said metal edge strips.

12. A continuous length of stock material as recited in claim 9, wherein said reinforcing spine stiffener is constructed from a material selected from the group consisting of metal, fiber or plastic.

13. A continuous length of stock material as recited in claim 9, wherein said reinforcing spine stiffener forms a flat metal ring which is centrally attached to said fabric strip, and substantially in parallel-alignment with said metal edge strips to form a continuous circular collar-shaped duct connector.

14. A continuous length of stock material as recited in claim 13, wherein said spine stiffener possesses sufficient flexural strength to withstand collapse inward when said fabric strip of said circular collar-shaped duct connector is subjected to an internal suction pressure.

15. A continuous length of pre-assembled, metal-to-fabric-to-metal stock material for fabricating custom-made duct connectors of varying diameters, comprising:

an elongate, continuous fabric strip;

an elongate first metal edge strip clenched to one side of said fabric strip;

an elongate second metal edge strip clenched to an opposite side of said fabric strip; and at least one elongate reinforcing spine stiffener comprising a flat metal strip attached to a first surface of said fabric strip, and running substantially parallel to said metal edge strips, thereby stiffening said continuous fabric strip.

16. A continuous length of stock material as recited in claim 15, wherein said reinforcing spine stiffener further includes a second flat metal strip attached to the inner surface of said fabric strip, and aligned with said first flat metal strip, said second flat metal strip being mechanically attached through said fabric strip to said first flat metal strip.

17. A continuous length of stock material as recited in claim 16, wherein said reinforcing spine stiffener is held in position on the fabric by a means selected from the group consisting of an adhesive, heat sealing, or stitching.

* * * * *